US005405279A

United States Patent [19]

Mastry et al.

[11] Patent Number: 5,405,279

[45] Date of Patent: Apr. 11, 1995

[54] ADAPTER FOR DIESEL ENGINES AND STERN DRIVES

[76] Inventors: Adib A. Mastry, 1281 79th St. South, St. Petersburg, Fla. 33707; Constantine E. Mastry, 12430 81st Pl. North, Seminole, Fla. 34642; Richard W. Mastry, 2220 Pinellas Point Dr. South, St. Petersburg, Fla. 33712

[21] Appl. No.: 239,142

[22] Filed: May 9, 1994

[51] Int. Cl.[6] ..... B63H 23/06

[52] U.S. Cl. ..... 440/75; 440/83

[58] Field of Search ..... 440/57, 75, 83, 111, 440/112; 464/52, 53, 87, 88, 92

[56] References Cited

U.S. PATENT DOCUMENTS

| | | | |
|---|---|---|---|
| 3,128,741 | 4/1964 | Benjamen | 440/112 |
| 3,136,285 | 6/1964 | Kiekhaefer | 440/57 |
| 3,376,842 | 4/1968 | Wynne | 440/112 X |
| 3,399,647 | 9/1968 | Alexander, Jr. et al. | 440/75 |
| 3,859,951 | 1/1975 | Woodfill | 440/112 |

*Primary Examiner*—Sherman Basinger

*Attorney, Agent, or Firm*—Joseph C. Mason, Jr.; Ronald E. Smith

[57] ABSTRACT

An adapter for interconnecting a marine engine to a stern drive includes an adapter ring having a pair of concentric flanges with bolt-receiving apertures formed in each of the flanges. The outermost flange is secured to the flywheel end of the engine. A coupler housing is secured to the flywheel end of the engine radially inwardly of the innermost flange of the adapter ring and houses a coupler having an internally splined rotatable part, and a bell housing having a radially outwardly extending flange is secured to the innermost flange of the adapter ring in housing relation to the coupler housing. A trailing end of the bell housing is secured to a transom housing which is centrally apertured to admit an externally splined stern drive rod to engage the rotatable, internally splined part of the coupler. In a second embodiment, the adapter ring is not employed and a smaller in diameter coupler housing is bolted directly to the flywheel end of the engine, but in all other respects is the same as the first embodiment.

2 Claims, 5 Drawing Sheets

ADAPTER FOR DIESEL ENGINES AND STERN DRIVES

BACKGROUND OF THE INVENTION

1. Field of the Invention

This invention relates, generally, to adapter devices having utility in interconnecting marine engines and stern drives.

2. Description of the Prior Art

Only one U.S. company makes diesel engines exclusively for the marine market. Other U.S. companies make diesel engines that are supplied to the marine market, but such engines are primarily truck engines that have been modified for marine applications. The horsepower to weight ratios, i.e., the horsepower to cubic inch displacement ratios of the modified truck engines are not as optimal as are the engines designed exclusively for marine applications. Moreover, the exclusively-for-marine use engines, unlike the modified truck engines, are sleeved engines and possess a reliability and durability unmatched by the modified truck engines. They are fuel injected and operate substantially smoke-free, unlike the marine engines manufactured by the truck engine manufacturers.

The stern drives driven by the engines, whether truck or true marine engines, work best when coupled to high horsepower, high revolutions per minute engines. If an engine produces high horespower at a relatively low rpm, its torque may exceed the structural capabilities of the stern drive to which it is coupled. Accordingly, stern drive manufacturers provide maximum torque specifications, and connection of a stern drive to an engine that produces torque in excess of said specifications will void the warranty on the stern drive. Such warranty-voiding coupling may also result in destruction of the stern drive. Numerous racing competitors have attempted to win races by connecting stern drives to high horsepower, high torque engines that exceed the limitations of the stern drive; the result is usually a destroyed stern drive.

The ideal engine would be light in weight and would produce high horsepower at low torque, i.e., at high engine rpms. A typical marine-modifed truck engine produces three hundred horsepower at twenty eight hundred rpms; this horsepower to rpm ratio is unacceptable for many stern drives because of the excessive torque produced. However, the engines produced solely for the marine market produce even more horsepower at higher engine rpms, i.e., at lower torque.

It would therefore seem logical that in racing competition, the purely marine engines should always prevail over the modified truck engines, but such is not the case. The stern drives that are coupled to the marine-only engines cannot take full advantage of the high horsepower, low torque engines to which they are connected due to their own structural limitations. Similarly, the stern drives coupled to the modified truck engines can handle the high torque supplied to them, but the rpms are insufficient to guarantee success in racing conditions. Thus, the conventional wisdom in the racing industry is that each competitor will have to find the right combination of horsepower, torque, and engine rpms on the engine side of the drive package, and torque limitations on the stern drive side of the package.

At the time the present invention was made, it was not obvious to those of ordinary skill in this art how the best marine-only engines could be used to drive the best stern drives. More particularly, the best marine engines could not even be coupled to the best stern drives due to structural incompatibility therewith.

SUMMARY OF THE INVENTION

The present invention provides an adapter means that enables interconnection of a high horsepower, low torque marine diesel engine and a stern drive heretofore unconnectable to such an engine. The adapter accommodates both six and four cylinder engines.

In the four cylinder embodiment, a coupler housing is bolted to the flywheel end of the engine, and a flanged coupler is mounted to the coupler housing. The coupler has a splined central bore that receives a mating splined rod rotatably mounted to the stern drive. A bell housing is also bolted to the flywheel end of the engine, radially outwardly of the coupler housing, and the inboard side of a transom housing is secured to the trailing end of the bell housing. The balance of the assembly is conventional ,i.e., the splined rod of the stern drive extends through the outboard side of the transom housing, the transom, and the inboard side of the transom housing to engage the splined central bore of the coupler.

In the six cylinder embodiment, an annular adapter is first secured to the flywheel side of the engine, and a coupler housing of greater diameter than the four cylinder coupler housing is also secured to the flywheel end of the engine, radially inwardly of the annular adapter. The coupler of the four cylinder embodiment is then placed within the coupler housing of the six cylinder embodiment, and the bell housing of the four cylinder embodiment is secured to the annular adapter. In all other respects, the assembly of the six cylinder adapter is the same as that of the four cylinder adapter.

To summarize, the same size bell housing and coupler are used for both embodiments. The coupler housing for the four cylinder engine has a diameter smaller than that of the coupler housing for the six cylinder engine, but in all other respects is the same. The annular adapter ring is used only in connection with six cylinder engines to enable use of the bell housing that directly fits onto the four cylinder engine.

It is a primary object of this invention to enable the interconnection of a high horseposer, low torque marine deisel engine to a high performance stern drive.

A related object is to accomplish the foregoing object in an elegant way, using few parts.

These and other important objects, features and advantages of the invention will become apparent as this description proceeds.

The invention accordingly comprises the features of construction, combination of elements and arangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
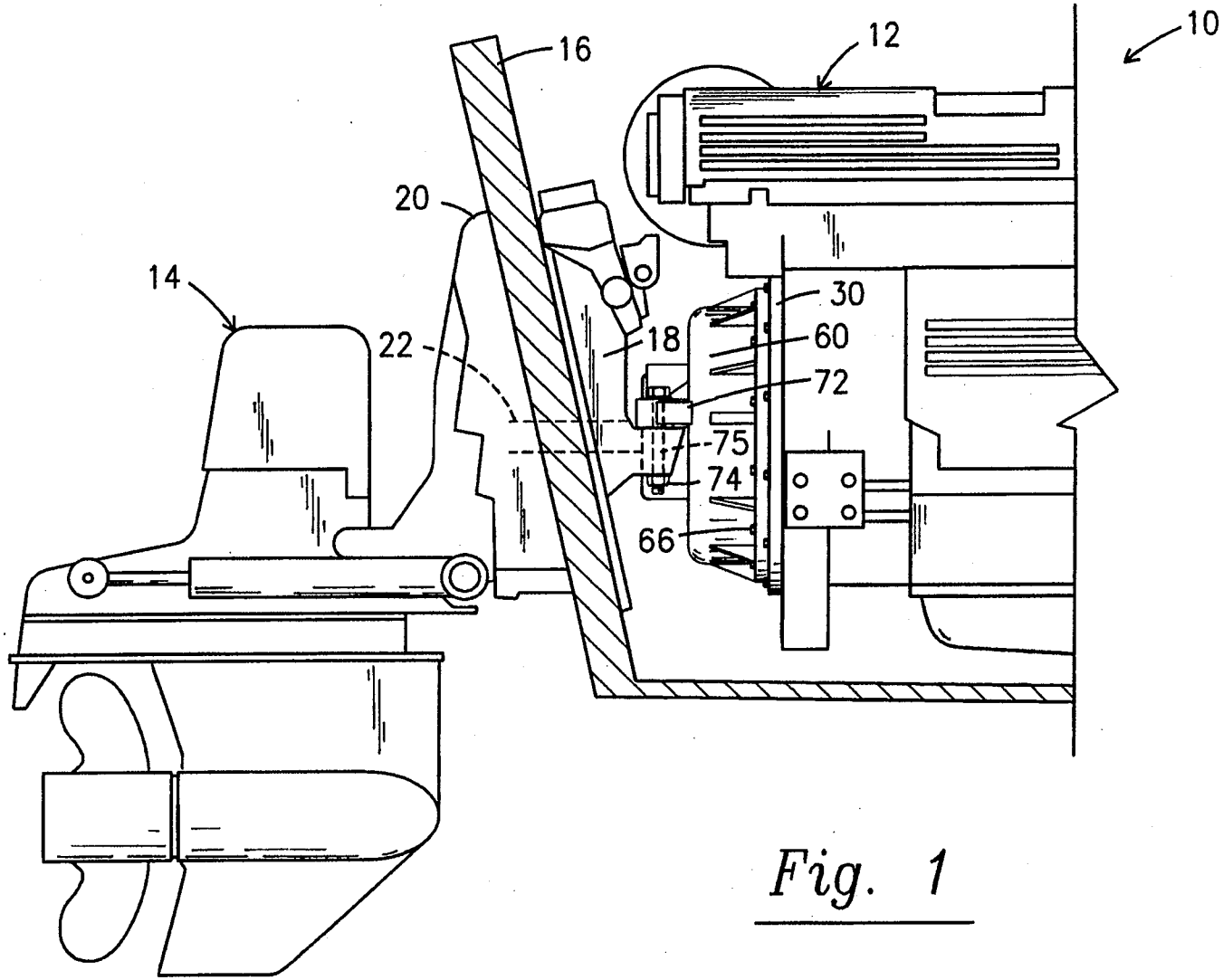
FIG. 1 is a side elevational view of an engine and an outdrive interconnected by the novel adaptor.

Referring now to FIG. 1. it will there be seen that an illustrative embodiment of the invention is denoted as a whole by the reference numeral 10.

Engine 12 is preferably a Yanmar (trademark) marine deisel engine manufactured in Japan by the Yanmar company. Specifically, the preferred engines are a Yanmar 4LH (four cylinder) and a Yanmar 6LY (six cylinder). The six cylinder engine produces three hundred fifteen horsepower at the propeller shaft at thirty four hundred rpms. The continuous propshaft horsepower is 260 at 3100 rpms. The engine weighs about twelve hundred pounds and its displacement is 5.2 liters (316 cubic inches). Comparable modified truck engines produce a little less horsepower at about 2800 rpms.

Stern drive 14 is preferably a Mercruiser Bravo III (trademark) manufactured by Mercury. The torque produced by the modified truck engines mentioned above exceeds the torque limits for the Bravo III, but the torque produced by the Yanmar engines does not, even though the Yanmar engines produce more horsepower.

Accordingly, it would seem desireable to interconnect a Yanmar engine to a Mercruiser Bravo III, but said parts do not interconnect.

Figure 2:
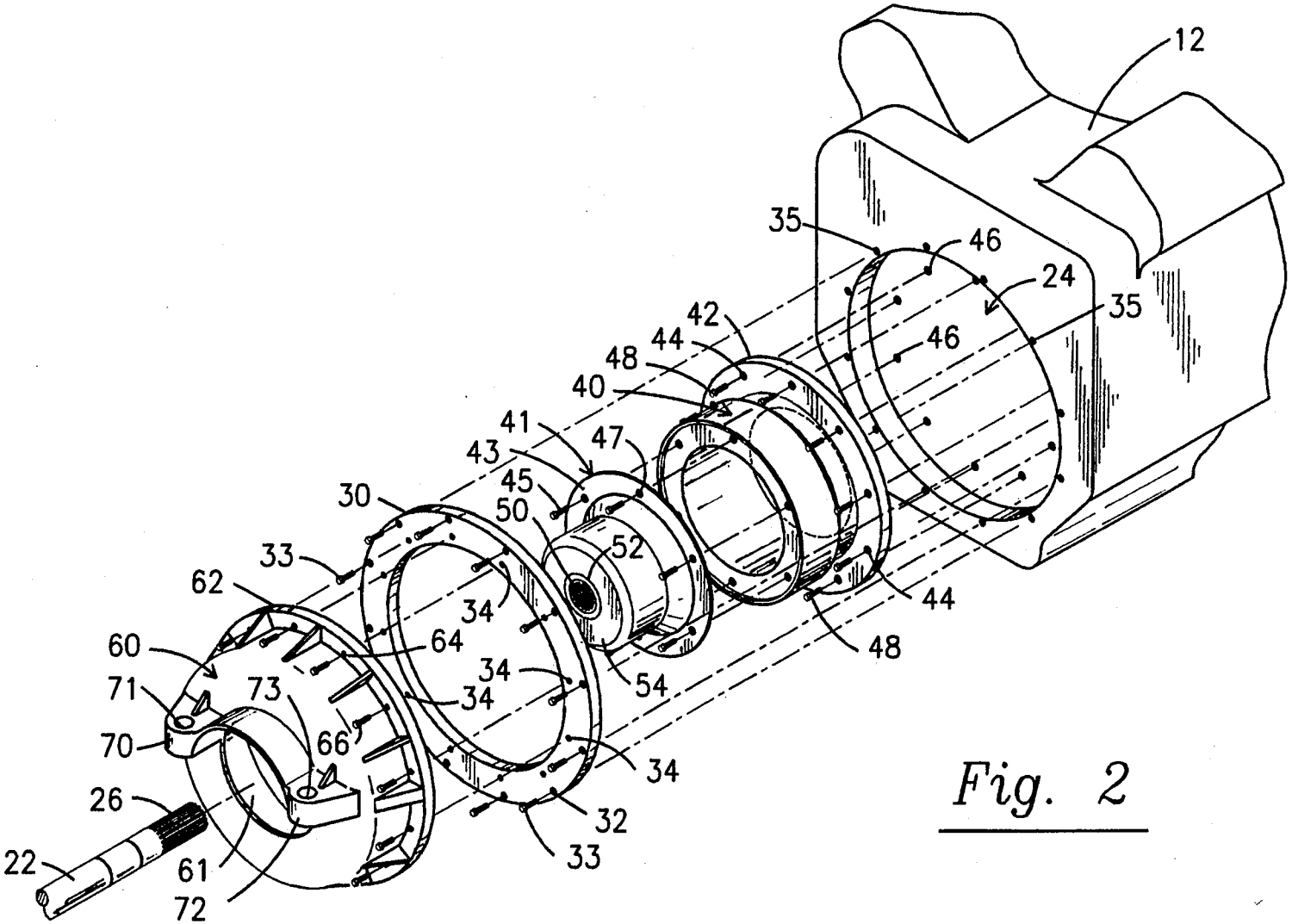
FIG. 2 is an exploded perspective view of the adaptor.

Transom 16 has an opening formed therein as is well known and is sandwiched between two halves 18, 20 of a conventional transom housing. Rod 22 extends from the stern drive 14 and interconnects said stern drive and engine 12 by engaging the splined central bore of the novel coupler as mentioned earlier and as will become more clear as this description proceeds. As shown in FIG. 2, the leading end of rod 22 has external splines 26 formed therein.

Referring now to FIG. 2, it will there be seen that adapter ring 30 has formed therein a first or outer ring of openings, collectively denoted 32, and a second or inner ring of openings, collectively denoted 34. To interconnect the six cylinder Yanmar engine to the Mercruiser Bravo III stern drive, adapter ring 30 is first secured to the flywheel end of the engine block by a plurality of bolts 33 disposed in openings 32. Those bolts extend into bolt-receiving apertures 35 formed in the flywheel end of the engine block.

Coupler housing 40 having flange 42 at its leading end and openings 44 formed in said flange is then secured to flywheel 24 of engine 12 by aligning openings 44 with bolt-receiving bores 46 formed in said flywheel and securing flange 42 to said flywheel with bolts 48.

Coupler 41 having an internally splined central bore 50 that slideably receives the above-mentioned external splines 26 of stern drive rod 22 is then secured to the trailing end of housing 40 by securing flange 43 to the trailing end of coupler housing 40 with bolts 45 that extend through throughbores 47 formed in flange 43 and into openings 49 formed in the trailing end of coupler housing 40 as shown. Note that the trailing end of housing 40 is recessed, and that the depth of the recess is about equal to the thickness of flange 43.

Central bore 50 is formed in a rotatably mounted cylinder 52 that is surrounded and cushioned by pad member 54.

Next, bell housing 60 having flange 62 with a plurality of openings 64 formed therein is secured to adapter ring 30 by positioning openings 64 into registration with openings 34 and joining them together with bolts 66.

Ears 70, 72 are formed in the trailing end of bell housing 60 and openings 71, 73 are formed therein; openings 71, 73 are placed into alignment with laterally spaced openings 75, 75 formed in inner transom housing 18, only one of which is visible in FIG. 1, and secured thereto with bolts 74, 74 only one of which may be seen in said side view.

As shown in FIG, 2, bell housing 60 is centrally apertured as at 61 to receive stern drive rod 22.

Figure 3:
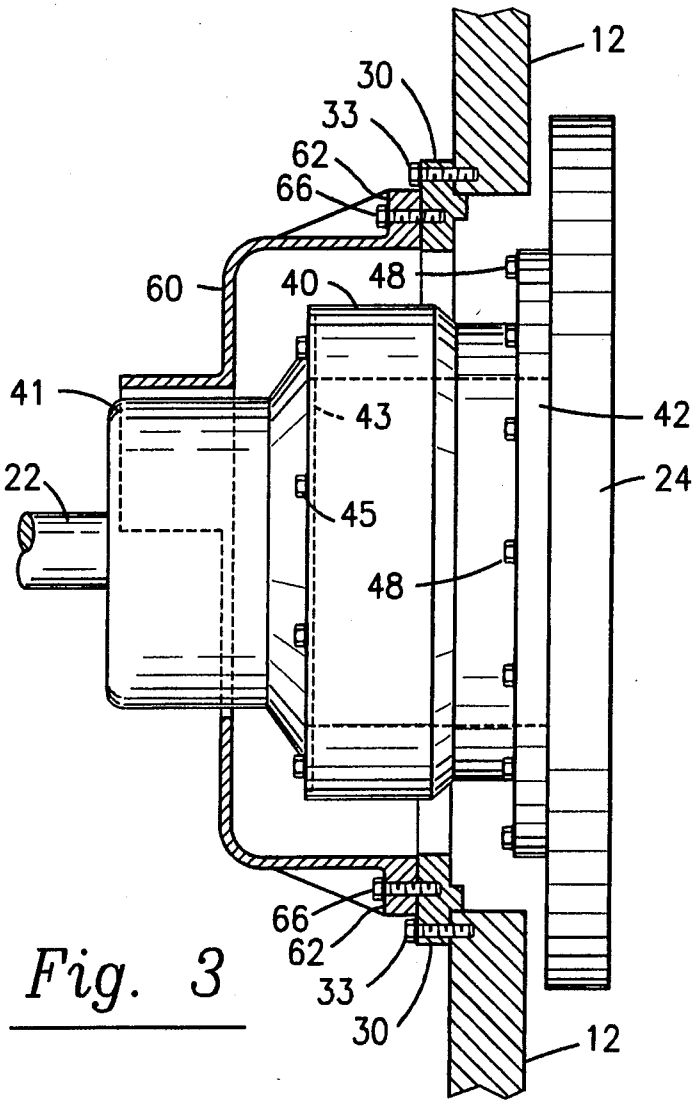
FIG. 3 is a side elevational partially sectioned view of the adaptor when assembled on a six cylinder engine.
Figure 5:
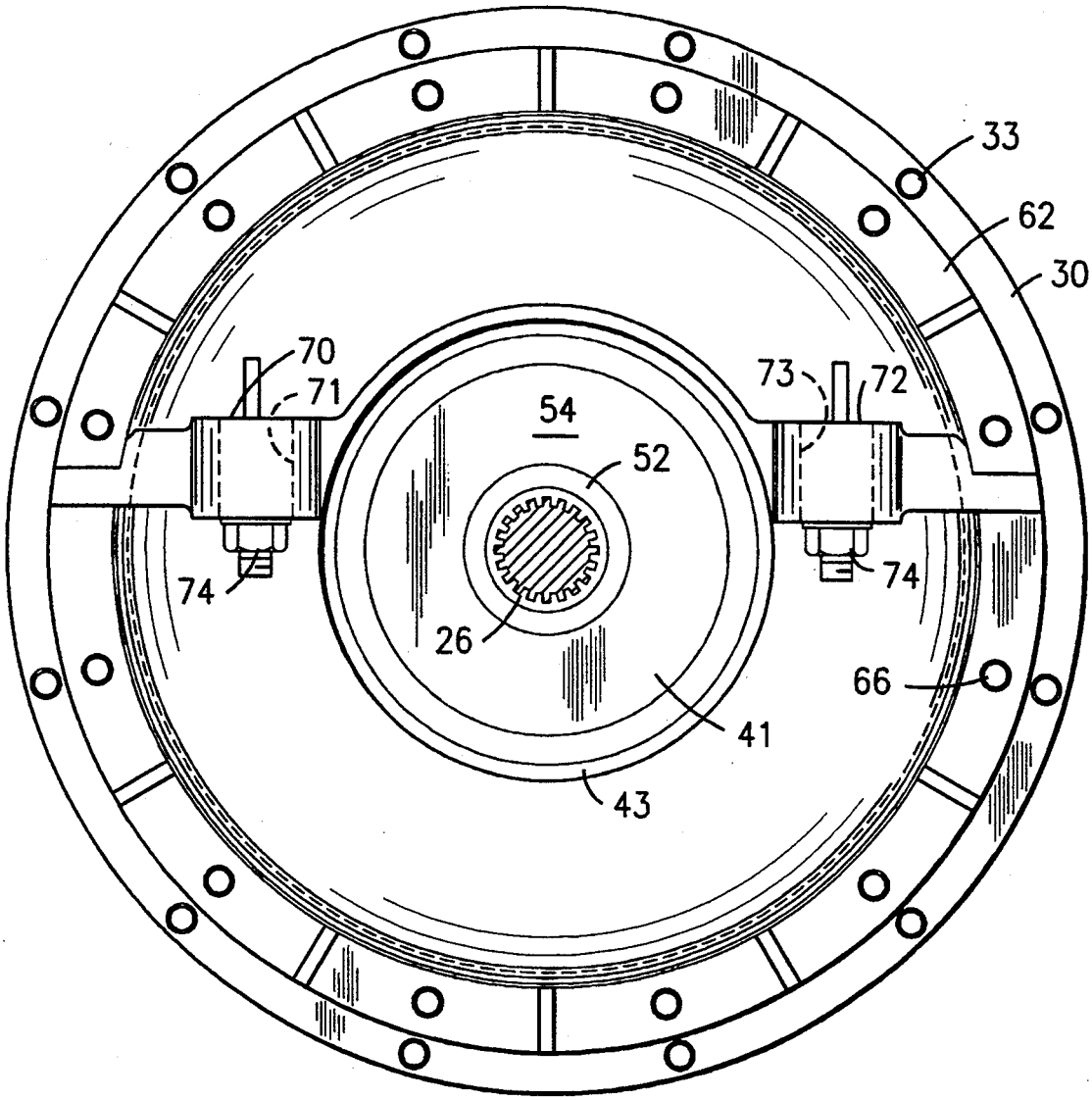
FIG. 5 is an end elevational view of the six cylinder embodiment.
Figure 6:
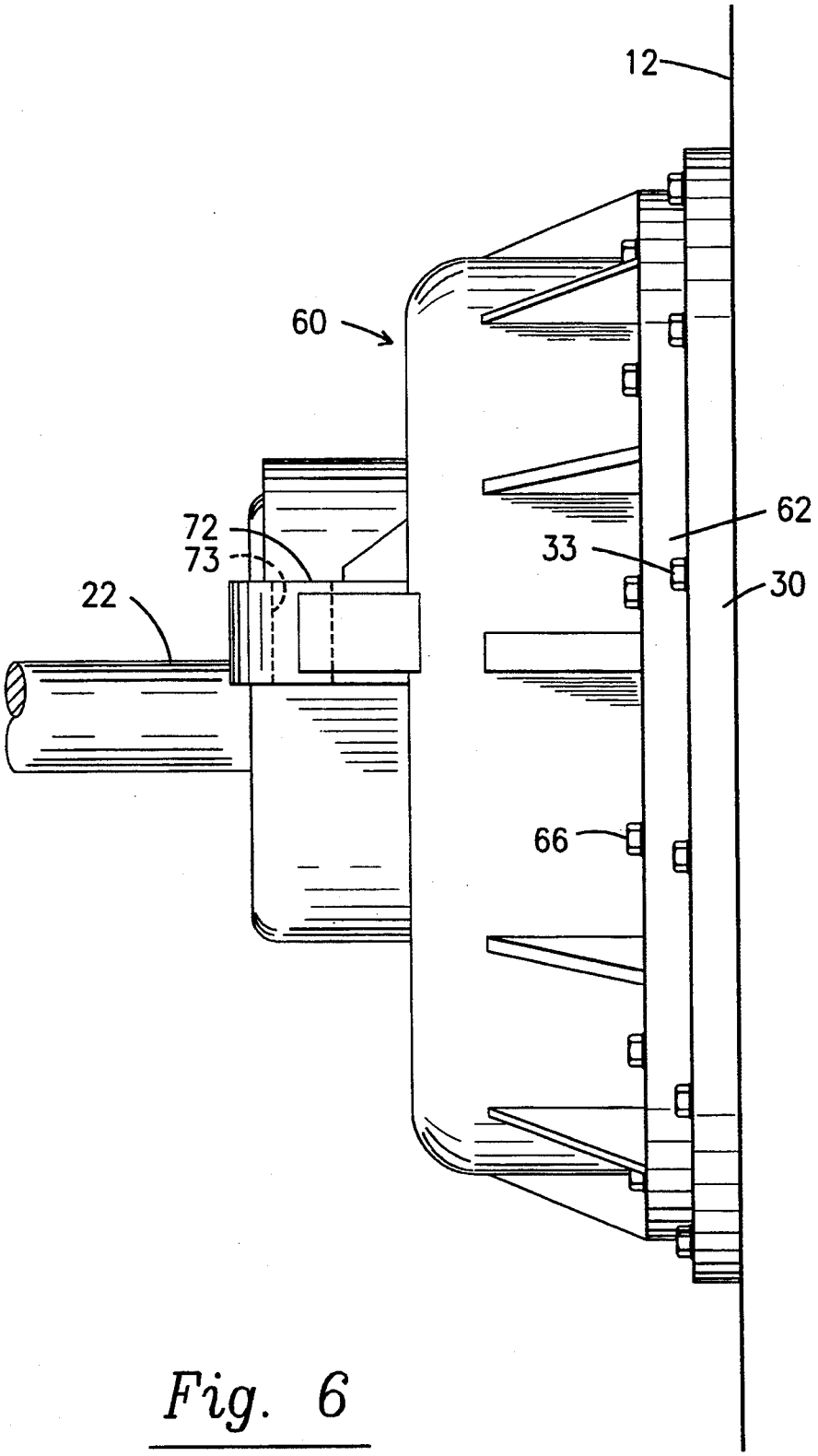
FIG. 6 is a side elevational view of the assembled adaptor.

FIG. 3 depicts all of the parts of FIG. 2 in their assembled configuration.

Figure 4:
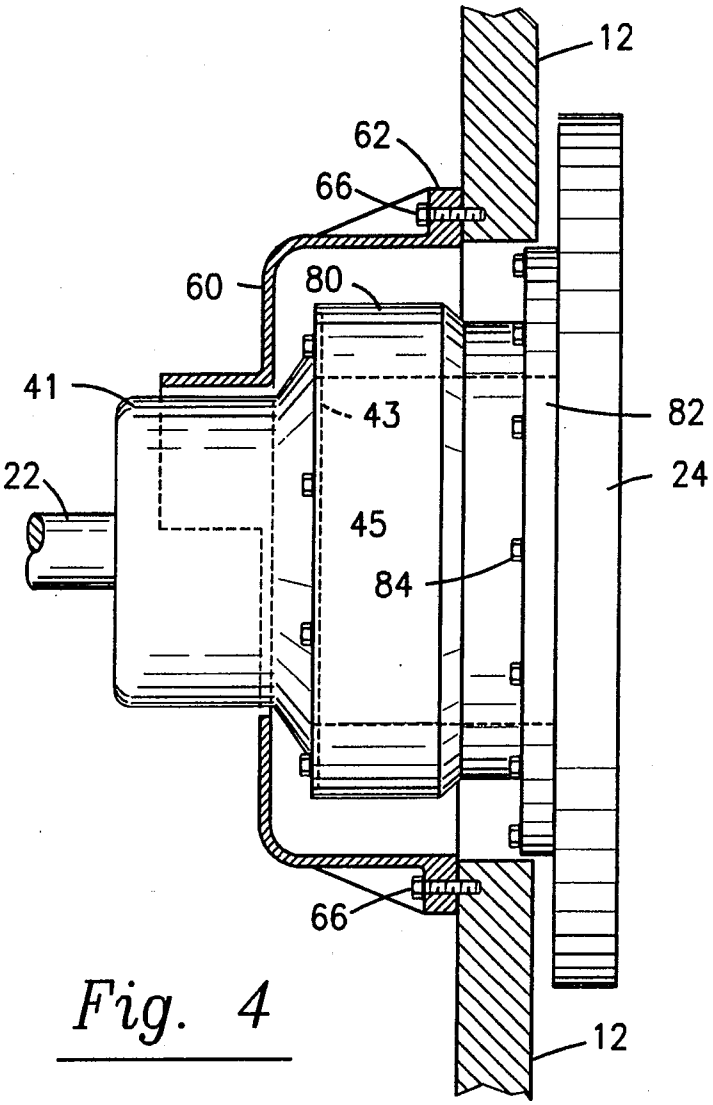
FIG. 4 is a side elevational partially sectioned view of the adaptor when assembled on a four cylinder engine.

Adapter ring 30 is not used in connecting the Mercruiser Bravo III stern drive to a four cylinder Yanmar marine diesel engine. As best understood in connection with FIG. 4, coupler housing 80, having less diameter than coupler housing 40, has flange 82 with throughbores formed therein; the throughbores are aligned with openings formed in the flywheel end of the engine and are secured thereto with bolts 84. Coupler 41 is then secured therewithin in the same way as in the six cylinder embodiment. Bell housing 60 is secured to the flywheel end of the engine by inserting bolts 66 into bolt-receiving bores 35 (FIG. 2) through openings 64 formed in flange 62. The trailing end of the bell housing is then secured to the inner transom wall in the same way as in the first embodiment.

Thus, adapter ring 30 is employed in the six cylinder embodiment but not in the four cylinder embodiment. The same bell housing is employed in both embodiments, and the coupler housing members of the two embodiments differ from one another in diameter only.

The adapter members disclosed herein have utility in interconnecting many different types of engines and stern drives and thus the invention is not limited to the particular interconnection mentioned herein; the particular interconnection depicted is believed to be the most optimal interconnection that can be made at the time of this disclosure, and future developments in engines and stern drives may make different combinations more desireable, of course. Any such future combinations are within the scope of the claims that follow, as a matter of law.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for interconnecting a stern drive to an engine, comprising:

an adapter ring secured to a flyweel end of an engine;

said adapter ring including an outer flange having a plurality of bolt-receiving apertures formed therein;

said adapter ring including an inner flange having a plurality of bolt-receiving apertures formed therein;

a coupler housing having a radially outwardly extending flange;

a plurality of bolt-receiving apertures formed in said flange of said coupler housing;

a coupler having an internally splined, rotatably mounted central part;

a centrally-apertured bell housing having a radially outwardly extending flange with a plurality of bolt-receiving openings formed in said outwardly extending flange; and a pair of bolt-receiving ears formed on a trailing end of said bell housing;

whereby a transom housing is secured to said bell housing by connection to said pair of bell housing ears;

whereby an externally splined stern drive rod extends through the central aperture formed in said bell housing and engages said internally splined central part of said coupler.

2. An apparatus for interconnecting a stern drive to an engine, comprising:

a coupler housing having a radially outwardly extending flange;

a plurality of bolt-receiving apertures formed in said flange of said coupler housing;

a coupler having an internally splined, rotatably mounted central part and a flange for enabling connection of said coupler to said coupler housing;

a centrally apertured bell housing having a radially outwardly extending flange with a plurality of bolt-receiving openings formed in said outwardly extending flange; and a pair of bolt-receiving ears formed on a trailing end of said bell housing;

said coupler housing being secured to a flywheel end of said engine and said coupler being secured to said coupler housing;

said bell housing being secured to said flywheel end of said engine in housing relation to said coupler housing;

whereby a transom housing is secured to said bell housing by connection to said pair of bell housing ears; and whereby an externally splined stern drive rod extends through the central aperture formed in said bell housing and engages said internally splined central part of said coupler.

* * * * *